US007397899B2

(12) United States Patent
Li

(10) Patent No.: US 7,397,899 B2
(45) **Date of Patent: *Jul. 8, 2008**

(54) X-RAY IRRADIATOR AND X-RAY IMAGING APPARATUS

(75) Inventor: Yuqing Li, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 204 days.

This patent is subject to a terminal disclaimer.

(21) Appl. No.: 11/297,283

(22) Filed: Dec. 8, 2005

(65) Prior Publication Data

US 2006/0126791 A1 Jun. 15, 2006

(30) Foreign Application Priority Data

Dec. 9, 2004 (CN) ..... 2004 1 0100384

(51) Int. Cl.
*G21K 1/02* (2006.01)

(52) U.S. Cl. ..... 378/147; 378/193; 378/205

(58) Field of Classification Search ..... 378/119, 378/140, 145, 147, 150, 151, 193, 205, 206; 250/505.1, 363.1
See application file for complete search history.

(56) References Cited

U.S. PATENT DOCUMENTS 4,122,350 A * 10/1978 Lipthay et al. ..... 378/37
4,123,657 A 10/1978 Krippner et al.
4,313,349 A 2/1982 Heitman et al.
4,880,985 A * 11/1989 Jones ..... 250/505.1
5,278,886 A * 1/1994 Kobiki et al. ..... 378/65
5,438,605 A 8/1995 Burke et al.
7,092,489 B2 * 8/2006 Li ..... 378/147

FOREIGN PATENT DOCUMENTS

JP 2003-061941 3/2003

OTHER PUBLICATIONS

Yuqing Li; X-Ray Irradiator and X-Ray Imaging Apparatus; Filed Dec. 8, 2005; 14 pgs.

* cited by examiner

*Primary Examiner*—Jurie Yun
(74) *Attorney, Agent, or Firm*—Armstrong Teasdale LLP

(57) ABSTRACT

With a view to providing an X-ray irradiator capable of detecting a relative rotational angle of a collimator box with respect to an X-ray tube, the X-ray irradiator comprises: an X-ray tube having a flange formed around an X-ray output window; a collimator box having an entry plate formed with an X-ray incidence window, the collimator box accommodating a collimator in the interior thereof; a ring provided on the entry plate so as to surround the X-ray incidence window, the ring receiving therein the flange of the X-ray tube and having a plurality of slots formed radially through the ring; a plurality of tongue pieces being inserted through the slots from outside to inside of the ring and holding down a back side of the flange; and sensor device provided inside the flange to detect a relative rotational angle of the collimator box with respect to the flange.

16 Claims, 10 Drawing Sheets

X-RAY IRRADIATOR AND X-RAY IMAGING APPARATUS

CROSS REFERENCE TO RELATED APPLICATIONS

This application claims the benefit of Chinese Application No. 200410100384.0 filed Dec. 9, 2004.

BACKGROUND OF THE INVENTION

The present invention relates to an X-ray irradiator and an X-ray imaging apparatus. Particularly, the present invention is concerned with an X-ray irradiator for irradiation of X-rays from an X-ray tube through a collimator, as well as an X-ray imaging apparatus using the X-ray irradiator.

In an X-ray imaging apparatus, X-rays are radiated to a subject while limiting an irradiation field by means of a collimator. The collimator is housed within a collimator box attached to an X-ray tube (see, for example, Patent Literature 1).

[Patent Literature 1] Japanese Unexamined Patent Publication No. 2003-61941 (page 3, FIG. 1)

A certain object requires to be photographed in an appropriately rotated state of a collimator box relative to an X-ray tube. When the collimator box is rotated, a frame of a display image also rotates. For correcting this state to obtain an erected image frame constantly, it is necessary to detect a rotational angle of the collimator box.

SUMMARY OF THE INVENTION

Therefore, it is an object of the present invention to provide an X-ray irradiator capable of detecting a relative rotational angle of a collimator box with respect to an X-ray tube, as well as an X-ray imaging apparatus using such an X-ray irradiator.

In one aspect of the present invention for achieving the above-mentioned object there is provided an X-ray irradiator comprising: an X-ray tube having a flange formed so as to surround an X-ray output window; a collimator box having an entry plate formed with an X-ray incidence window, the collimator box accommodating a collimator in the interior thereof; a ring provided on the entry plate so as to surround the X-ray incidence window, the ring receiving therein the flange of the X-ray tube and having a plurality of slots formed radially through the ring; a plurality of tongue pieces being inserted through the slots from outside to inside of the ring and holding down a back side of the flange; and a sensor means provided inside the flange to detect a relative rotational angle of the collimator box with respect to the flange.

In another aspect of the present invention for achieving the above-mentioned object there is provided an X-ray imaging apparatus having an X-ray irradiator and an X-ray detector both opposed to each other, the X-ray irradiator comprising: an X-ray tube having a flange formed so as to surround an X-ray output window; a collimator box having an entry plate formed with an X-ray incidence window, the collimator box accommodating a collimator in the interior thereof; a ring provided on the entry plate so as to surround the X-ray incidence window, the ring receiving therein the flange of the X-ray tube and having a plurality of slots formed radially through the ring; a plurality of tongue pieces being inserted through the slots from outside to inside of the ring and holding down a back side of the flange; and a sensor means provided inside the flange so as to detect a relative rotational angle of the collimator box with respect to the flange.

For making non-contact detection possible, it is preferable that the sensor means be an optical sensor means.

For detecting a relative rotational angle properly, it is preferable for the optical sensor means to have an optical pattern provided on the flange side and an optical sensor provided on the entry plate side.

For obtaining a continuous pattern free of a break, it is preferable that the optical pattern form a ring along an inner periphery of the flange.

For facilitating the detection of an angle, it is preferable for the optical pattern to be a comb teeth-like pattern.

For making an angle original clear, it is preferable that the comb teeth-like pattern have a notch for an angle origin.

For preventing an excessive rotation, it is preferable for the X-ray irradiator to be provided with a limiting means for limiting a maximum rotational angle of the collimator box.

For the simplification of construction, it is preferable that the limiting means have a pin provided on the entry plate side and an arcuate slot provided on the flange side so as to engage the pin.

According to the present invention it is possible to provide an X-ray irradiator comprising: an X-ray tube having a flange formed so as to surround an X-ray output window; a collimator box having an entry plate formed with an X-ray incidence window, the collimator box accommodating a collimator in the interior thereof; a ring provided on the entry plate so as to surround the X-ray incidence window, the ring receiving therein the flange of the X-ray tube and having a plurality of slots formed radially through the ring; a plurality of tongue pieces being inserted through the slots form outside to inside of the ring and holding down a back side of the flange; and a sensor means provided inside the flange to detect a relative rotational angle of the collimator box with respect to the flange, and is possible to provide an X-ray imaging apparatus using the X-ray irradiator.

Further objects and advantages of the present invention will be apparent from the following description of the preferred embodiments of the invention as illustrated in the accompanying drawings.

DETAILED DESCRIPTION OF THE INVENTION

Figure 1:
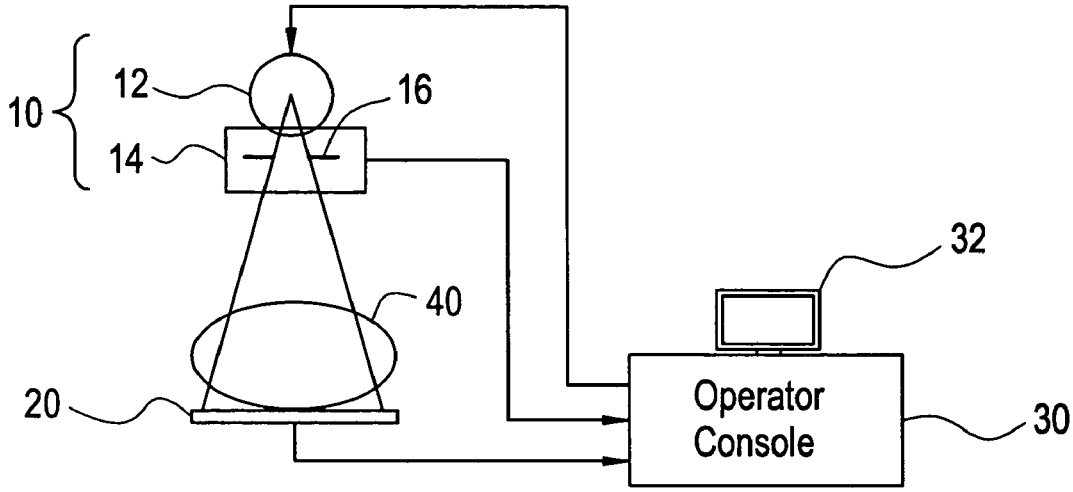
FIG. 1 shows a schematic construction of an X-ray imaging apparatus.

The best mode for carrying out the present invention will be described hereinunder with reference to the drawings. The present invention is not limited to the best mode. FIG. 1 shows a schematic construction of an X-ray imaging apparatus. This apparatus is an embodiment of the present invention. With the construction of this apparatus, there is shown an embodiment of the X-ray imaging apparatus of the present invention.

As shown in the same figure, this apparatus includes an X-ray irradiator 10, an X-ray detector 20, and an operator console 30. The X-ray irradiator 10 and the X-ray sensor 20 are opposed to each other with a subject 40 therebetween. The X-ray irradiator 10 is an embodiment of the present invention. With the construction of this device, there is shown an embodiment of the X-ray irradiator of the present invention.

The X-ray irradiator 10 includes an X-ray tube 12 and a collimator box 14. A collimator 16 is housed within the collimator box 14. X-rays emitted from the X-ray tube 12 are radiated to the subject 40 through an aperture of the collimator 16. The aperture of the collimator 16 is variable so that the X-ray irradiation field can be adjusted. A relative rotational angle of the collimator box 14 with respect to the X-ray tube 12 can be adjusted.

The X-rays which have passed through the subject 40 is detected by the X-ray detector 20 and the detected signal is inputted to the operator console 30. In accordance with the inputted signal the operator console 30 reconstruct a radioscopic image of the subject 40. The radioscopic image thus reconstructed is displayed on a display 32 disposed on the operator console 30. Further, the operator console 30 controls the X-ray irradiator 10.

A rotational angle is inputted from the collimator box 14 to the operator console 30. In accordance with the inputted angular signal the operator console 30 corrects the rotation of the frame of the display image so that the image frame is erected constantly irrespective of rotation of the collimator box 14.

Figure 2:
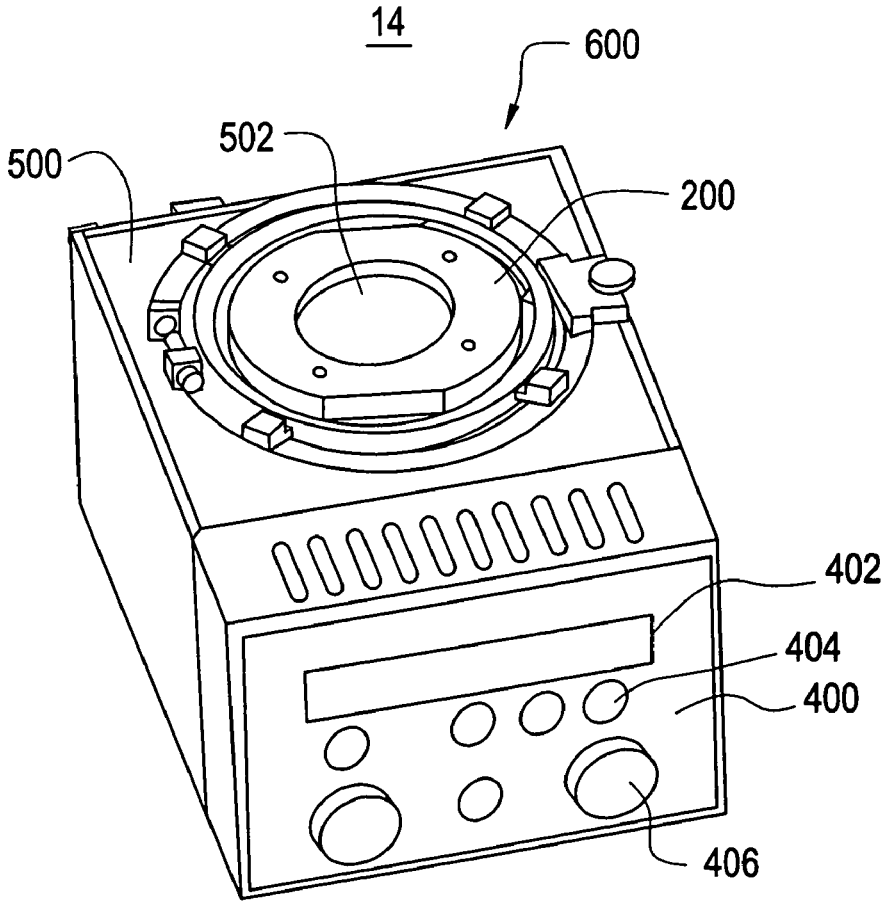
FIG. 2 shows an appearance of a collimator box.

FIG. 2 shows the appearance of the collimator box 14 together with a flange 200 of the X-ray tube 12 attached thereto. The X-ray tube 12 lies on the flange 200 and is rendered integral with the flange. Thus, the flange 200 is a part of the X-ray tube 12.

As shown in the same figure, the collimator box 14 is a box of a generally rectangular parallelepiped and houses the collimator 16 therein. A front side of the collimator box 14 is formed as an interface 400 which is used for an operator to adjust the aperture of the collimator 16. An indicator 402, buttons 404, and controls 406, are provided on the interface 400.

An upper surface of the entry plate 14 is constituted by an entry plate 500. The entry plate 500 has an X-ray incidence window 502. A mounting mechanism 600 for mounting the collimator box 14 to the flange 200 of the X-ray tube 12 is provided around the X-ray incidence window 502.

Figure 3:
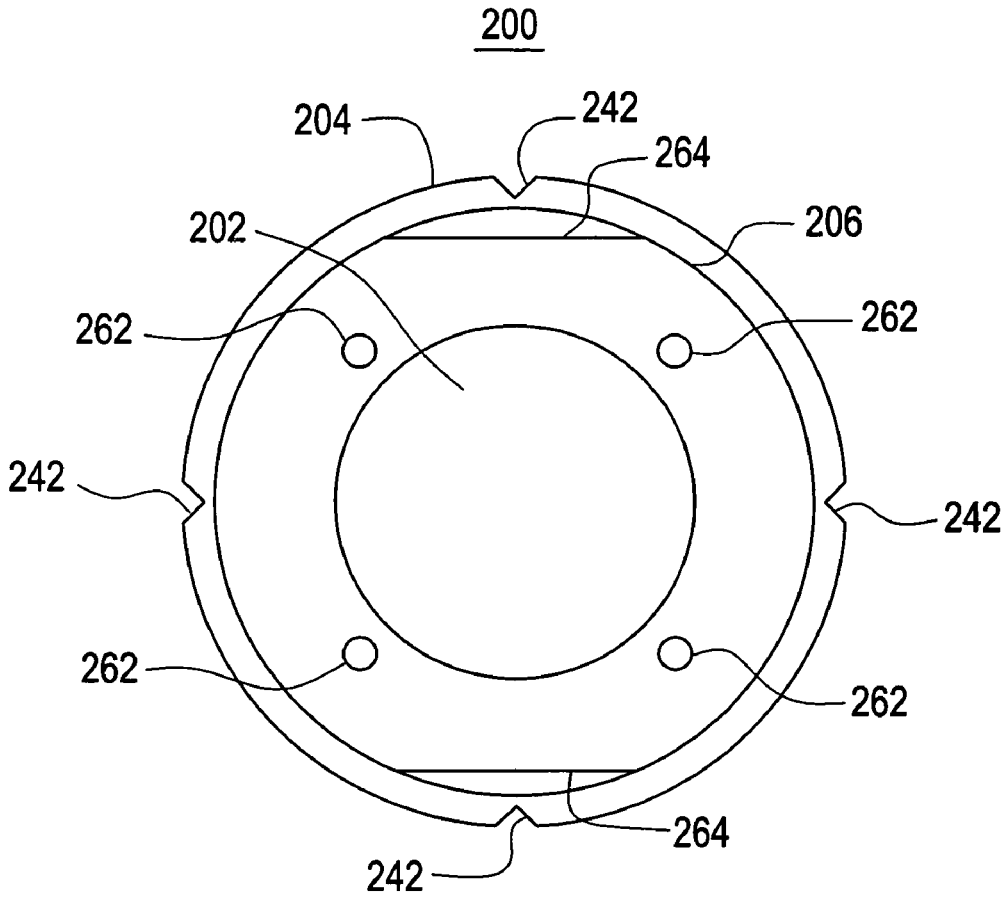
FIG. 3 is a plan view of a flange of an X-ray tube.
Figure 4:
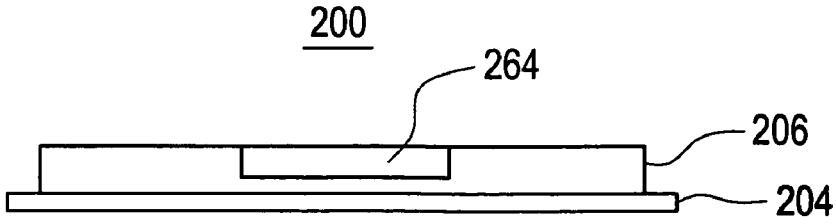
FIG. 4 is an elevation thereof.

FIGS. 3 and 4 are a plan view and an elevation of the flange 200. As shown in the same figure, the flange 200 is a stepped disc having a central aperture 202. The central aperture 202 serves as an X-ray output window.

A large-diameter portion 204 of the disc has four notches 242 formed in the edge of the disc at equal intervals in the circumferential direction. The notch 242 is a V-shaped notch. A divergent angle of V is, for example, 90°. Four holes 262 for screwing the disc to the body of the X-ray tube are formed in a small-diameter portion 206 of the disc at equal intervals in the circumferential direction and in parallel with the axis of the disc. A pair of parallel surfaces 264 for indicating a reference direction are formed sideways of the small-diameter portion 206.

Figure 5:
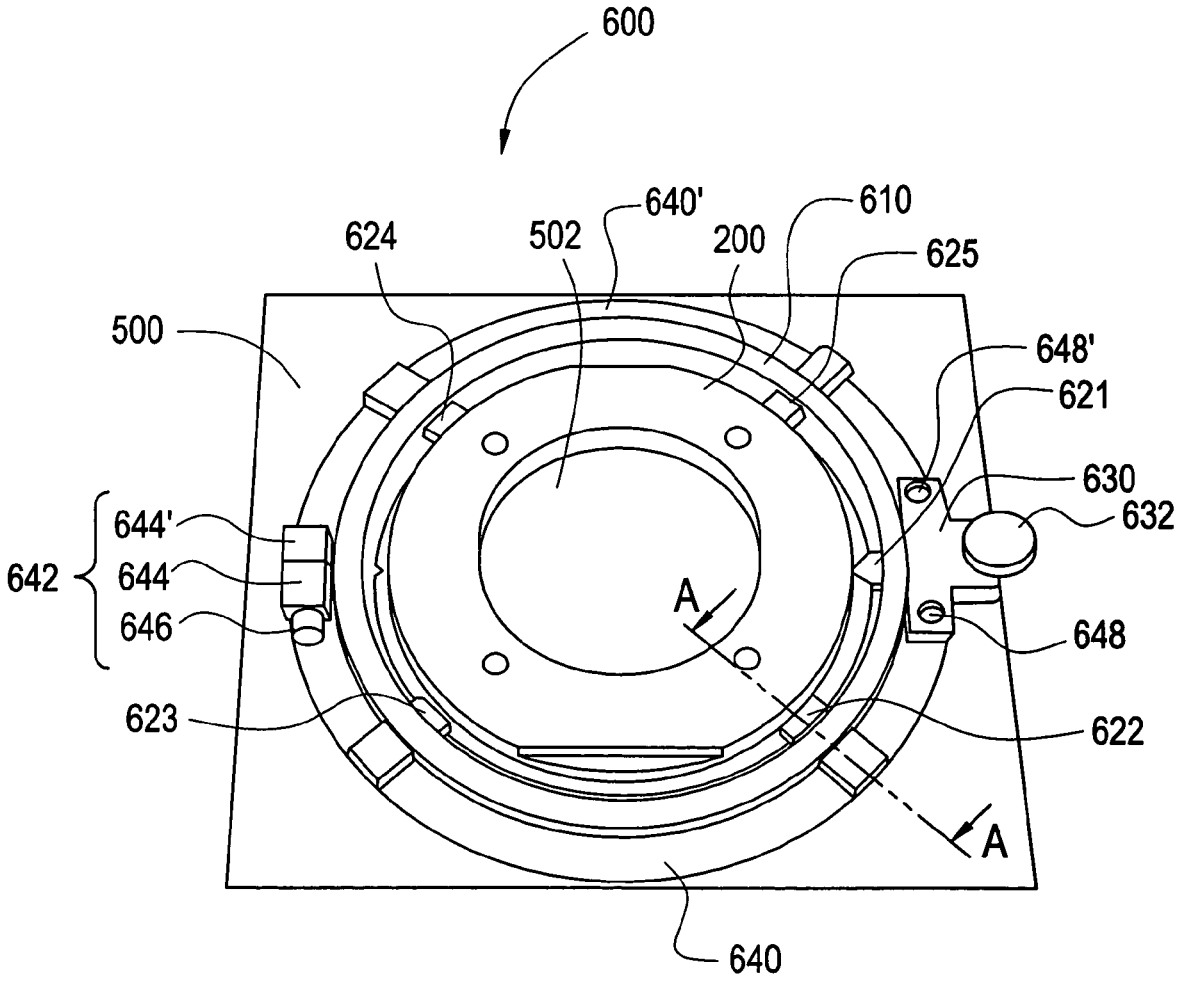
FIG. 5 shows the construction of a collimator box mounting mechanism.

FIG. 5 shows a close-up of the entry plate 500 having the mounting mechanism 600, together with the flange 200. As shown in the same figure, the mounting mechanism 600 has a ring 610. The ring 610 is mounted on the entry plate 500 so as to be concentric with the X-ray incidence window 502. Mounting of the ring 610 to the entry plate 500 is performed with screws or the like from the back side for example. The ring 610 has an inside diameter conforming to the outside diameter of the large-diameter portion 204 of the flange 200. As a result, the flange 200 can be received in a fitted state within the ring 610.

The ring 610 has five slots to be described later which extend radially through the ring, and five tongue pieces 621-625 are inserted through those slots from outside to inside of the ring 610.

The tip of one tongue piece 621 is adapted to fit in a notch 242 formed in the flange 200. The tongue piece 621 is pushed out from a sheath 630 located outside the ring 610 by means of a spring. A lock screw 632 is provided on the sheath 630 so that it can lock the tongue piece 621.

The tongue piece 621 biased by the spring constitutes a click mechanism together with the notches 242. Since there are four notches 242 at equal intervals along the circumference of the flange 200, the click mechanism can restrict the rotational angle of the collimator box 14, i.e., the rotational angle of the X-ray irradiation field in 90° step. The number and spacing of the notches 242 may be determined suitably in accordance with a desired rotational angle step. Further, the rotational angle of the collimator box 14 may be set at an arbitrary angle intermediate the click position.

The rotational position of the collimator box 14 is fixed by locking the tongue piece 621 with the lock screw 632. With the lock screw 632, it is possible to lock and unlock the tongue piece 621 easily.

The remaining four tongue pieces 622 to 625 hold down the back side of the large-diameter portion 204 of the flange 200 from above at four equally spaced positions, whereby the collimator box 14 is clamped to the X-ray tube 12.

Since the four tongue pieces 622-625 hold down the back side of the large-diameter portion 204 of the flange 200 along the circumference at four equally spaced positions, the flange can be held down uniformly. The number of tongue pieces for holding down the flange 200 may be three or five or more.

A pair of semicircular rings 640 and 640' each take a partial charge of holding the tongue pieces 622-625 outside the ring 610. More specifically, the tongue pieces 622 and 623 are held by the semicircular ring 640, while the tongue pieces 624 and 625 are held by the semicircular ring 640'.

Mounting of the tongue pieces 622-625 to the semicircular rings 640 and 640' is performed by screwing from the back side of the semicircular rings 640 and 640'. By so doing, in an assembled state of the mounting mechanism, it becomes impossible to make access to the screw head and thus there is no fear of loosening the screw by mistake which would lead to fall-off of the collimator box 14.

Figure 6:
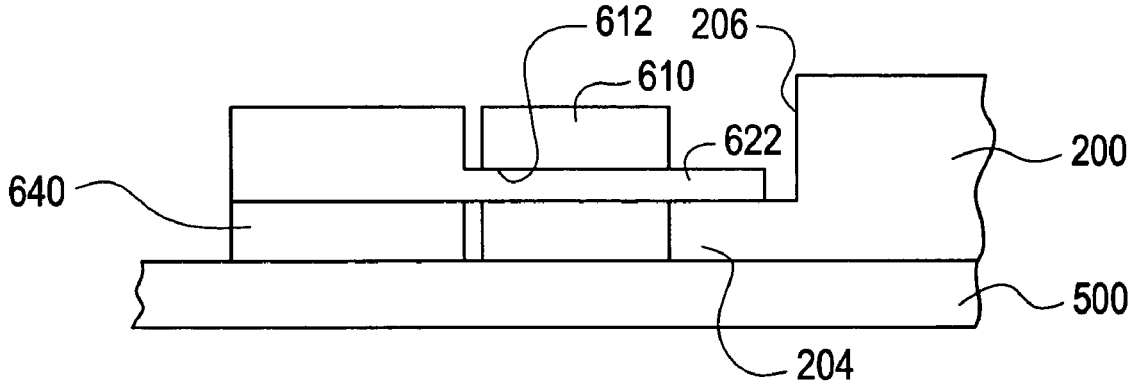
FIG. 6 shows in what state the flange is held down.

FIG. 6 shows in what state the flange 200 is held down by the tongue piece 622. FIG. 6 corresponds to a sectional view taken on line A-A in FIG. 5. As shown in FIG. 6, the tongue piece 622 held by the semicircular ring 640 is inserted from the outside to the inside through a slot 612 formed in the ring 610 and holds down the back side of the large-diameter portion 204 of the flange 200. As a result, the large-diameter portion 204 of the flange 200 is sandwiched in between the tongue piece 622 and the entry plate 500. This is also the case with the other tongue pieces 623-625.

The semicircular rings 640 and 640' are disposed so that their one ends are opposed to each other and so are their opposite ends to surround the ring 610. The respective one ends of the semicircular rings 640 and 640' are connected together by a connecting means 642. For example, the connecting means 642 comprises a pair of nuts 644 and 644' fixed to one ends of the semicircular rings 640 and 640' respectively and a bolt 646 which connect those nuts with each other.

The other ends of the semicircular rings 640 and 640' are mounted to the entry plate 500 with pins 648 and 648' respectively. The semicircular rings 640 and 640' are rotatable about the pins 648, 648' and along the surface of the entry plate 500. Therefore, when the connection by the connecting means is released, the semicircular rings 640 and 640' can be rotated in opposite directions, i.e., in an opening direction.

Figure 7:
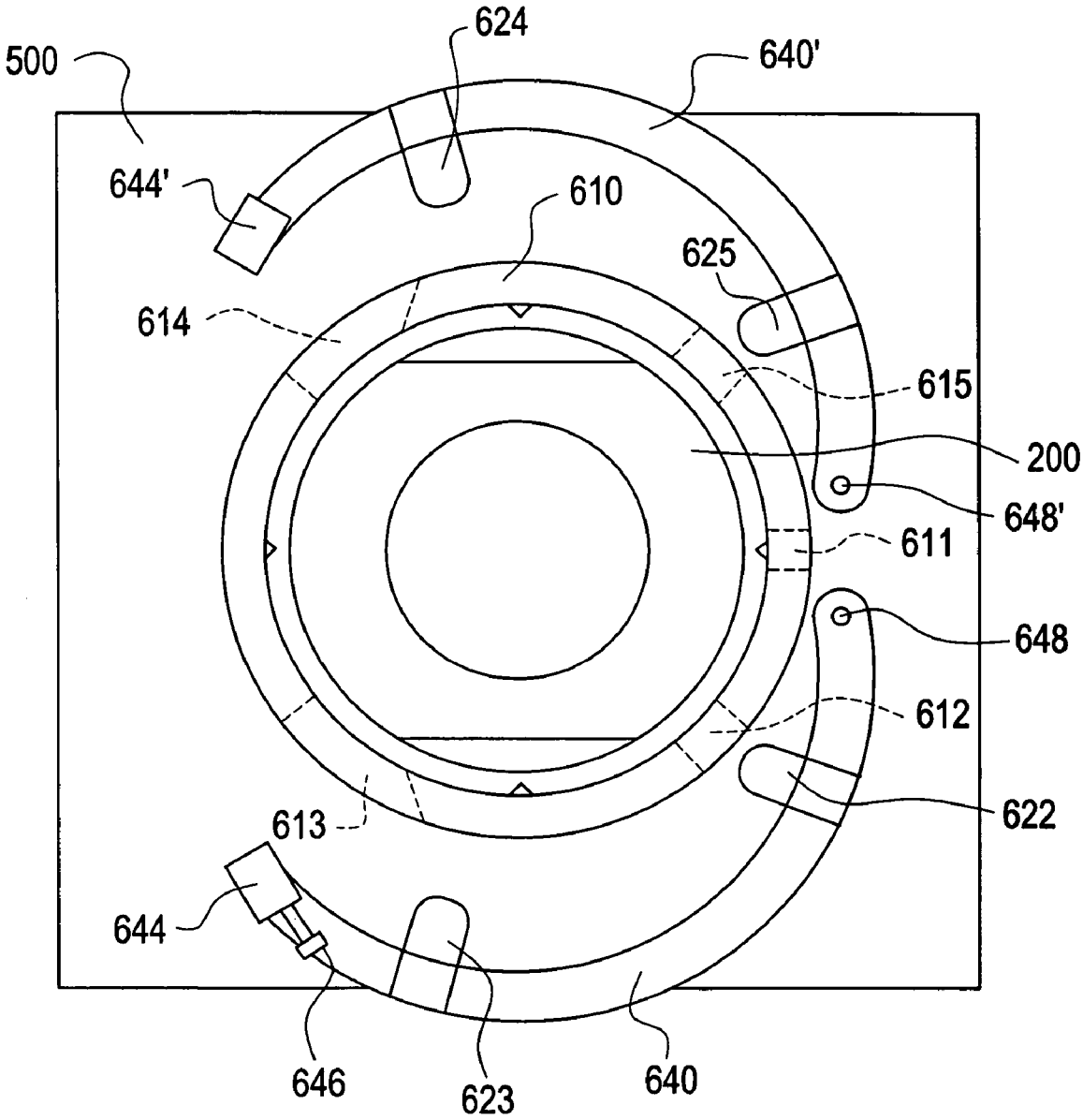
FIG. 7 shows a released state of the flange.

This state is shown in FIG. 7, in which the illustration of the tongue piece 621, sheath 630 and lock screw 632 is omitted. As shown in the same figure, the semicircular rings 640 and 640' are widely open on their one end sides and the four tongue pieces 622-625 are disengaged from the slots 612-615. In this state, the flange 200 is no longer held down by the tongue pieces 622-625, so that the collimator box 14 can be taken out from the X-ray tube 12.

For mounting the collimator box 14 to the X-ray tube 12, the semicircular rings 640 and 640' are kept open and the flange 200 of the X-ray tube 12 is fitted in the ring 610, then the semicircular rings 640 and 640' are closed and their one ends are connected together by the connecting means 642.

Figure 8:
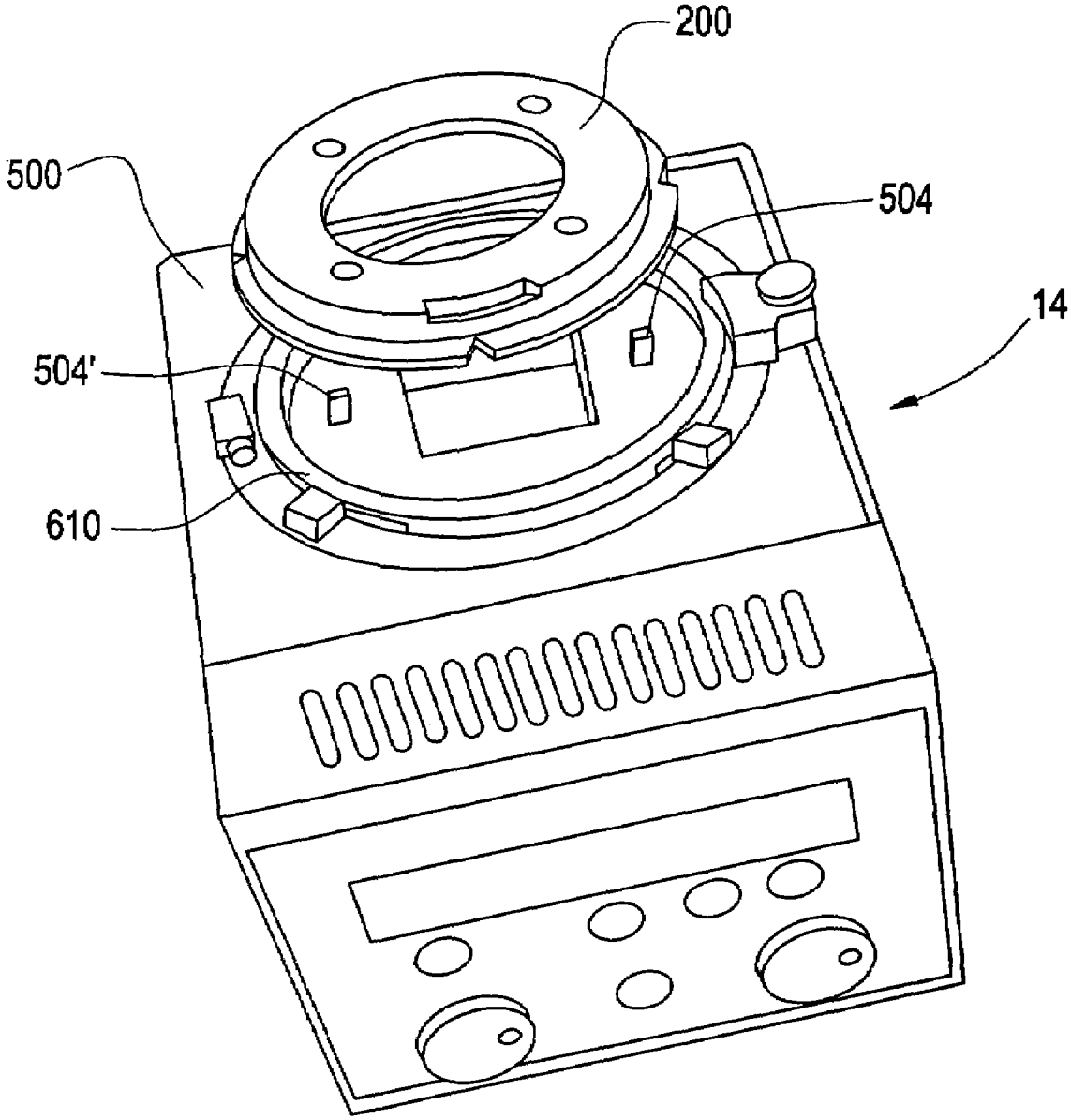
FIG. 8 shows a removed state of the collimator box from the flange.

FIG. 8 shows a removed state of the collimator box 14 from the flange 200. As shown in the same figure, a pair of sensors 504 and 504' are provided on the entry plate 500 of the collimator box 14 at positions inside the ring 610. The sensors 504 and 504' are symmetric with respect to the center of the ring 610. The sensors 504 and 504' are each an optical sensor having a light emitting portion and a light receiving portion.

Figure 9:
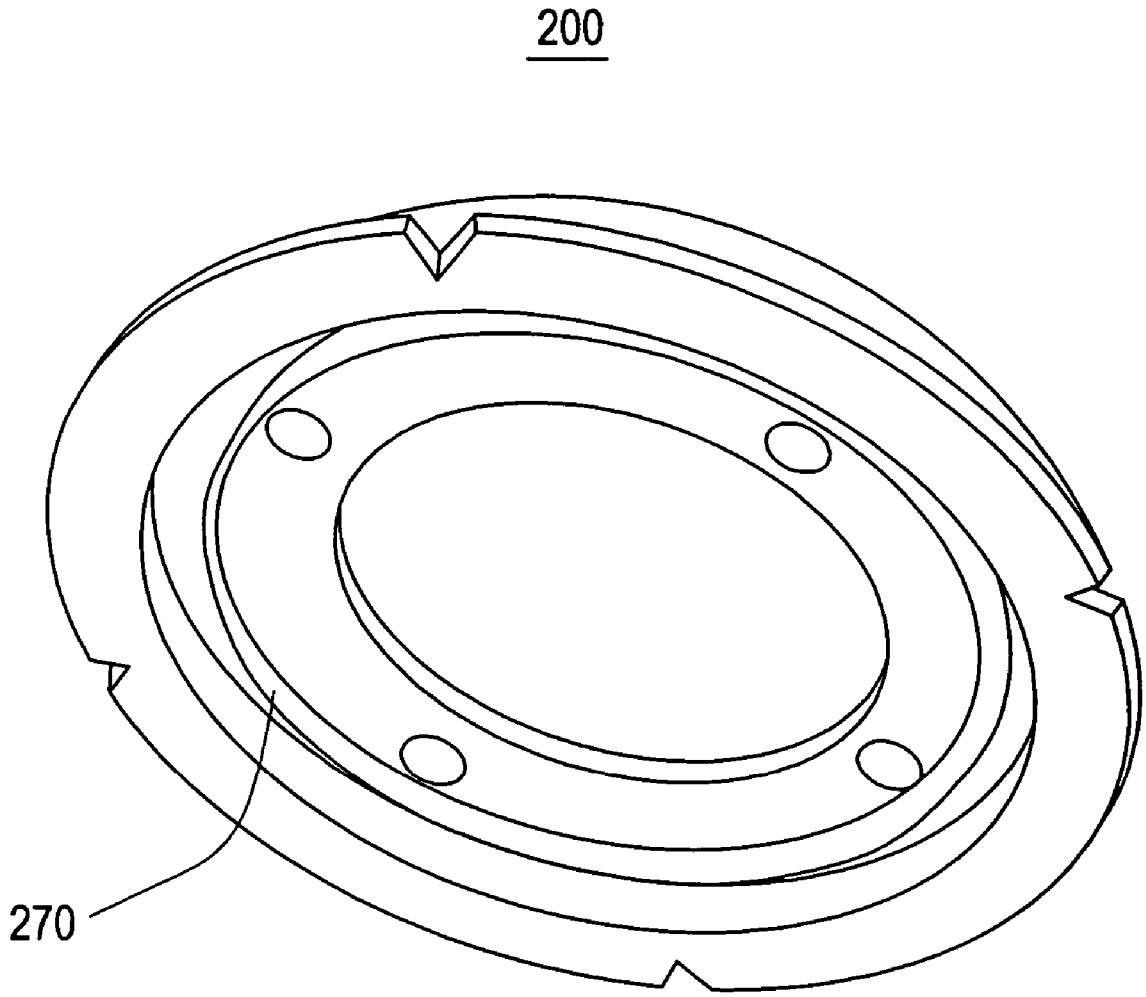
FIG. 9 shows the flange as seen obliquely from below.

FIG. 9 shows the flange 200 as seen obliquely from below. As shown in the same figure, the inside of the flange 200 is scooped out concentrically and a ring 270 is provided therein concentrically.

Figure 10A:
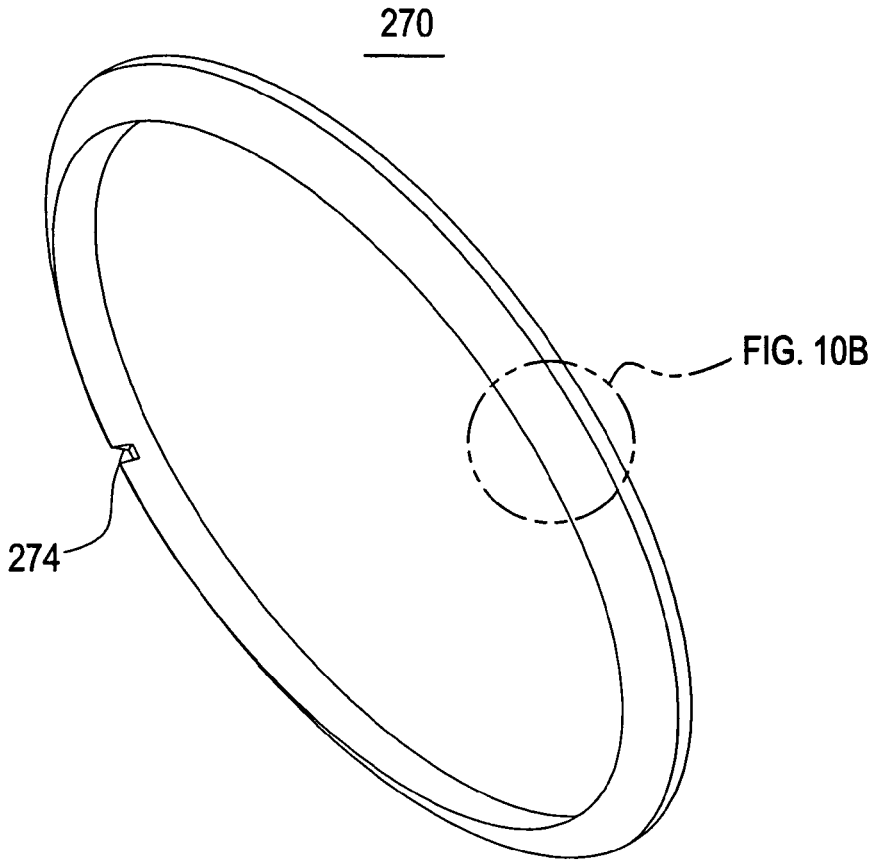
FIGS. 10(*a*) and 10(*b*) show a ring alone provided inside the flange.
Figure 10B:
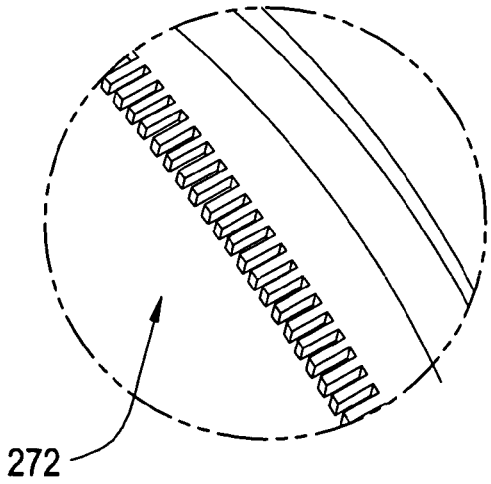

FIG. 10 shows the ring 270 alone. As shown in a partially enlarged manner in (b) of the same figure, the ring 270 has a comb teeth-like structural portion 272. The comb teeth-like structural portion 272 is provided on one side of the ring 270 and along the whole circumference so as to project axially of the ring. A notch 274 able to make distinction from the other portion is formed in one position of the comb teeth-like structural portion 272.

When the collimator box 14 is mounted to the flange 200, the sensors 504 and 504' are opposed to the comb teeth-like structural portion 272 at positions inside the flange 200. The sensors 504 and 504' each radiate light to the comb teeth-like structural portion 272 and receive reflected light.

The comb teeth-like structural portions 272 form optical patterns of alternately arranged teeth and gaps. Therefore, when the collimator box 14 is rotated with respect to the flange 200, the reflected light undergoes strong and weak pulses. Accordingly, a rotational angle can be measured on the basis of the number of such pulses.

If the phase of the photo-detection by the sensors 504 and 504' is made different by only half of the comb teeth pitch, it becomes possible to perform the detection of angle with a resolving power twice as high as the resolving power determined by the comb teeth pitch. When the comb teeth pitch is very small, there may be used only one of the sensors 504 and 504'.

Thus, the portion comprising the sensors 504, 504' and the ring 270 constitutes an optical angle encoder. The notch 274 formed at one position of the comb teeth-like structural portion 272 determines an origin of the angle encoding.

Since such an angle encoder is incorporated in the flange 200, a rotational angle of the collimator box 14 can be fed back to the operator console 30 from the X-ray irradiator 10. Then, the operator console 30 can correct the angle of the image frame in accordance with the rotational angle of the collimator box 14.

The portion comprising the sensors 504, 504' and the ring 270 is an example of the sensor means in the present invention. Since the sensor means is an optical sensor means, it is possible to make a non-contact angle detection. Further, since the optical sensor means has an optical pattern provided on the flange side and an optical sensor provided on the entry plate side so as to be opposed to the optical pattern, a relative rotational angle can be detected properly.

Since the optical pattern forms a ring along the inner periphery of the flange, it is possible to obtain a continuous pattern free of a break. Since the optical pattern is a comb teeth-like pattern, the detection of an angle is easy. Moreover, since the comb teeth-like pattern has a notch for an angle origin, it is possible to make an angle origin clear.

Figure 11A:
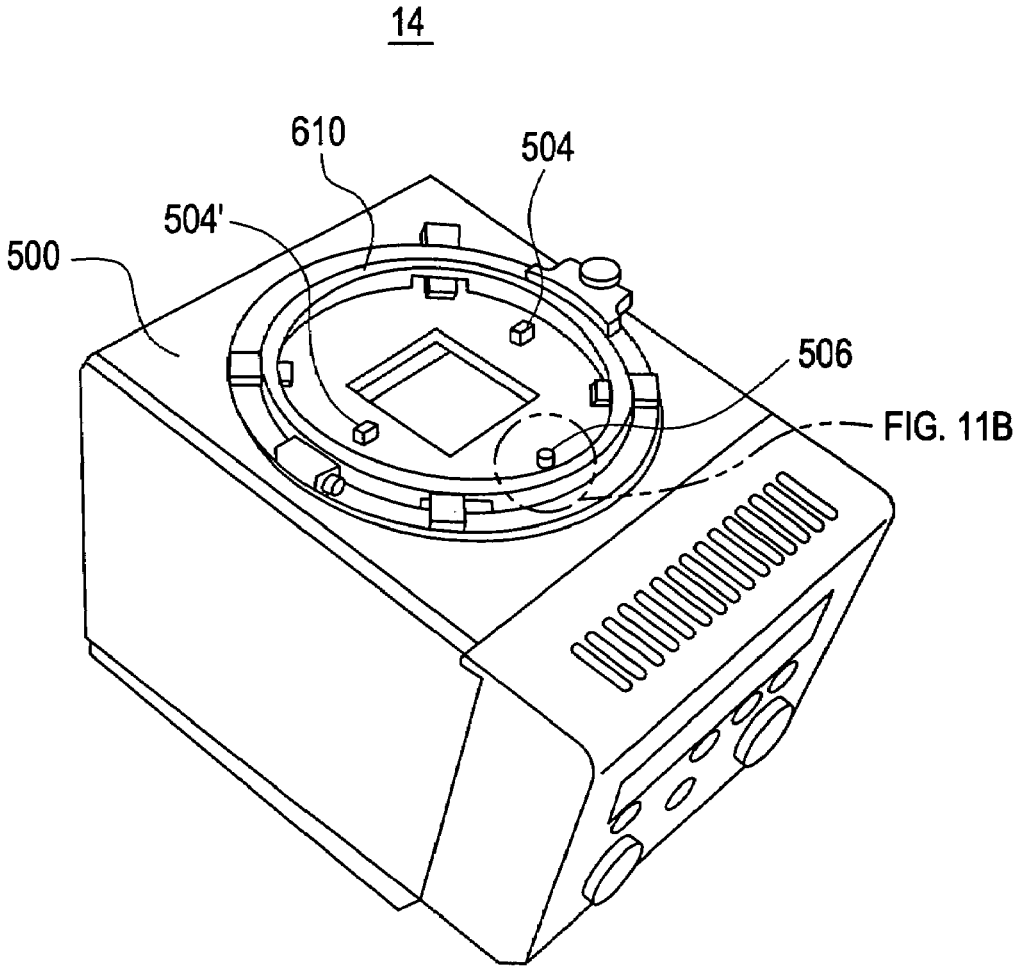
FIGS. 11(*a*) and 11(*b*) show the collimator box.
Figure 11B:
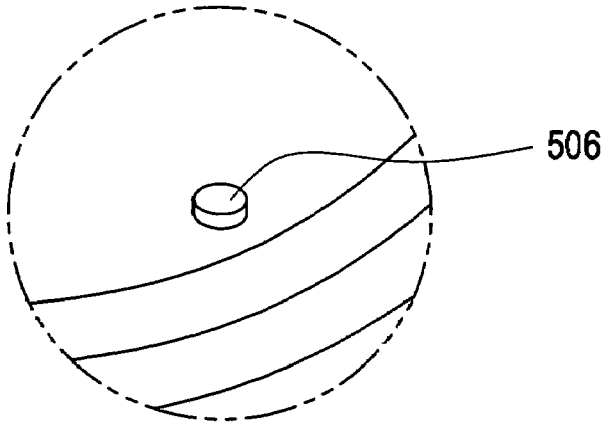
Figure 12:
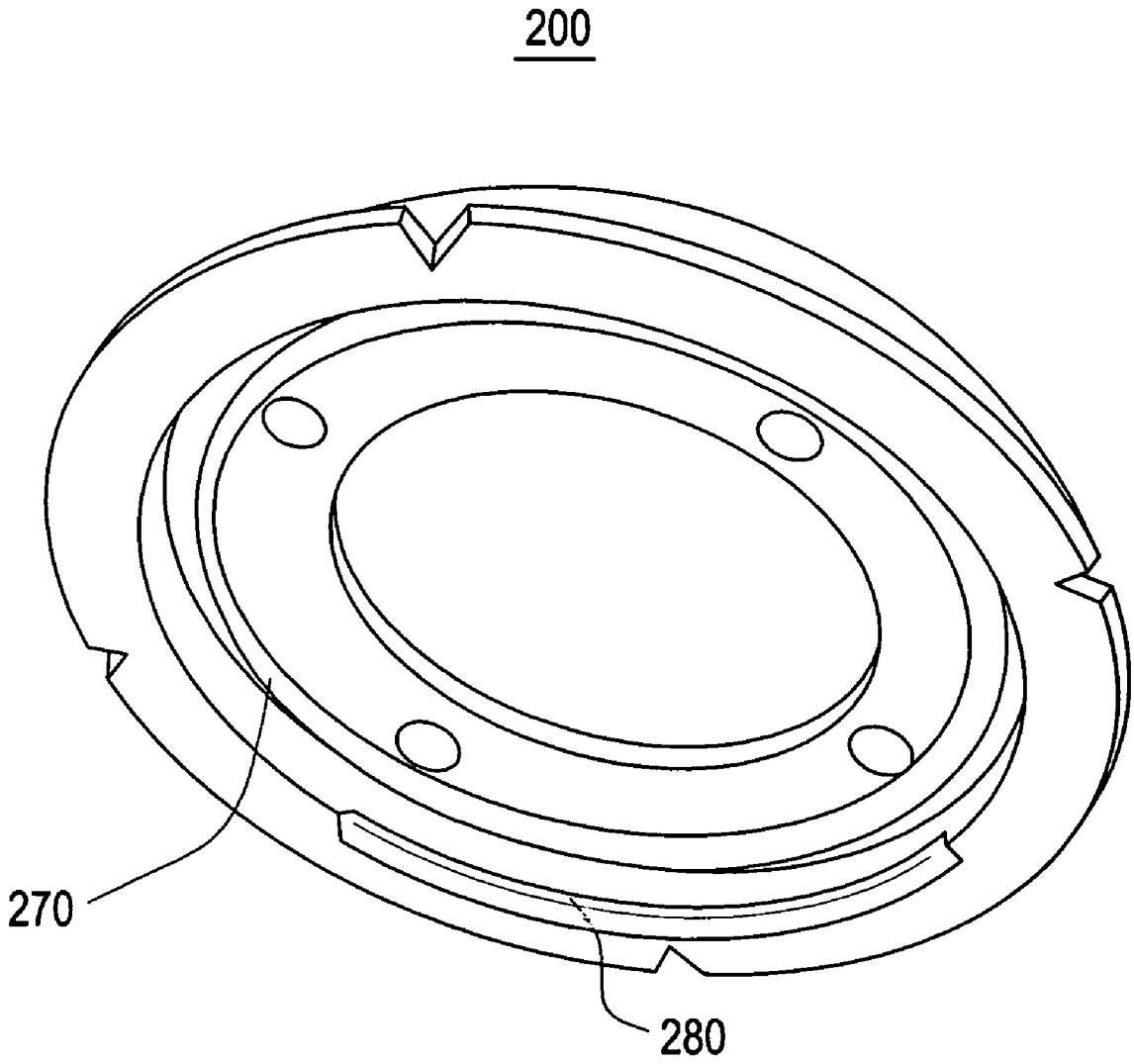
FIG. 12 shows the flange as seen obliquely from below.

As shown in FIG. 11, if a pin 506 is provided on the entry plate 500 and an arcuate slot 280 is formed correspondingly in an end face of the flange 200 as in FIG. 12, a maximum rotational angle value of the collimator box 14 can be limited by the length of the slot 280 when engaged with the pin 506. The portion comprising the pin 506 and the slot 280 is an example of the limiting means in the present invention.

By thus using the limiting means for limiting the maximum rotational angle of the collimator box, it is possible to prevent an excessive rotation of the collimator box. Since the limiting means has the pin provided on the entry plate side and the arcuate slot provided on the flange side, it is possible to simplify the construction.

Many widely different embodiments of the invention may be configured without departing from the spirit and the scope of the present invention. It should be understood that the present invention is not limited to the specific embodiments described in the specification, except as defined in the appended claims.

The invention claimed is:

1. An X-ray irradiator comprising:

an X-ray tube having a flange formed so as to surround an X-ray output window;

a collimator box having an entry plate formed with an X-ray incidence window, the collimator box accommodating a collimator in the interior thereof;

a ring provided on the entry plate so as to surround the X-ray incidence window, the ring receiving therein the flange of the X-ray tube and having a plurality of slots formed radially through the ring;

a plurality of tongue pieces being inserted through the slots from outside to inside of the ring and holding down a back side of the flange; and a sensor device provided inside the flange to detect a relative rotational angle of the collimator box with respect to the flange.

2. An X-ray irradiator according to claim 1, wherein the sensor device is an optical sensor device.

3. An X-ray irradiator according to claim 2, wherein the optical sensor device has an optical pattern provided on the flange side and an optical sensor provided on the entry plate side so as to be opposed to the optical pattern.

4. An X-ray irradiator according to claim 3, wherein the optical pattern forms a ring along an inner periphery of the flange.

5. An X-ray irradiator according to claim 4, wherein the optical pattern is a comb teeth-like pattern.

6. An X-ray irradiator according to claim 5, wherein the comb teeth-like pattern has a notch for an angle origin.

7. An X-ray irradiator according to claim 1, further comprising a limiting device for limiting a maximum rotational angle of the collimator box.

8. An X-ray irradiator according to claim 7, wherein the limiting device has a pin provided on the entry plate side and an arcuate slot provided on the flange side so as to engage the pin.

9. An X-ray imaging apparatus having an X-ray irradiator and an X-ray detector both opposed to each other, the X-ray irradiator comprising:

an X-ray tube having a flange so as to surround an X-ray output window;

a collimator box having an entry plate formed with an X-ray incidence window, the collimator box accommodating a collimator in the interior thereof;

a ring provided on the entry plate so as to surround the X-ray incidence window, the ring receiving therein the flange of the X-ray tube and having a plurality of slots formed radially through the ring;

a plurality of tongue pieces being inserted through the slots from outside to inside of the ring and holding down a back side of the flange; and a sensor device provided inside the flange to detect a relative rotational angle of the collimator box with respect to the flange.

10. An X-ray imaging apparatus according to claim 9, wherein the sensor device is an optical sensor device.

11. An X-ray imaging apparatus according to claim 10, wherein the optical sensor device has an optical pattern provided on the flange side and an optical sensor provided on the entry plate side so as to be opposed to the optical pattern.

12. An X-ray imaging apparatus according to claim 11, wherein the optical pattern forms a ring along an inner periphery of the flange.

13. An X-ray imaging apparatus according to claim 12, wherein the optical pattern is a comb teeth-like pattern.

14. An X-ray imaging apparatus according to claim 13, wherein the comb teeth-like pattern has a notch for an angle origin.

15. An X-ray imaging apparatus according to claim 9, further comprising a limiting device for limiting a maximum rotational angle of the collimator box.

16. An X-ray imaging apparatus according to claim 15, wherein the limiting device has a pin provided on the entry plate side and an arcuate slot provided on the flange side so as to engage the pin.

* * * * *